United States Patent [19]

Goldfarb

[11] 4,206,565

[45] Jun. 10, 1980

[54] LIQUID ACTIVITY TOY

[76] Inventor: Adolph E. Goldfarb, 4614 Monarca Dr., Tarzana, Calif. 91356

[21] Appl. No.: 876,365

[22] Filed: Feb. 9, 1978

[51] Int. Cl.[2] ..... A63H 29/10

[52] U.S. Cl. ..... 46/41; 46/92

[58] Field of Search ..... 46/41, 42, 91, 92; 40/406, 407

[56] References Cited

U.S. PATENT DOCUMENTS

| | | | |
|---|---|---|---|
| 328,206 | 10/1885 | Freeman | 46/41 |
| 1,429,684 | 9/1922 | Muldner, Jr. | 46/41 |
| 2,884,200 | 4/1959 | Konikson | 46/41 X |
| 2,968,120 | 1/1961 | Reed | 46/91 |
| 3,117,394 | 1/1964 | Wenger | 46/41 |
| 3,564,740 | 2/1971 | Calfee | 40/406 |
| 3,577,675 | 5/1971 | Kohner | 46/41 |
| 3,665,638 | 5/1972 | Weistrop | 46/41 |
| 4,056,895 | 11/1977 | Terrulli | 46/1 R |
| 4,057,244 | 11/1977 | Gaspar | 46/41 X |

FOREIGN PATENT DOCUMENTS

| | | | |
|---|---|---|---|
| 526254 | 5/1931 | Fed. Rep. of Germany | 46/91 |

*Primary Examiner*—John F. Pitrelli
*Assistant Examiner*—G. Lee Skillington
*Attorney, Agent, or Firm*—Robert M. Ashen; Robert J. Schaap

[57] ABSTRACT

A liquid activity toy having a housing with one or more reservoirs into which the child user can introduce a liquid, such as water, to operate one or more actuators to cause one or more actions or activities to occur. One of these activities is the rising of an object to a position outwardly of the toy housing and thereafter a dropping of the object back into the housing, and where this object may represent a growing of a toy flower. Another activity which may occur by the introduction of water is the rising up of another object such as a toy animal and which may thereafter drop back into the housing of the toy. A third activity which may occur upon the introduction of water into the toy is the movement of an object representative of a toy animal or insect in a circular path as to represent a flying bee. The various actuators which cause the activities to occur are designed so that only a small amount of water which may be free flowing water is required to cause the desired activity. A substantial amount of action is generated with only a small amount of water and the action may continue even after the introducing of the water by the child user. As an added advantage, the toy may be used away from a source of water under pressure, e.g. a source of tap water.

9 Claims, 6 Drawing Figures

LIQUID ACTIVITY TOY

BACKGROUND OF THE INVENTION

1. Purpose of the Invention

This invention provides in general certain new and useful improvements in liquid activity toys, and, more particularly, liquid activity toys in which the introduction of a relatively small amount of liquid, such as water, into the toy by a child user actuates means to cause one or more activities to occur, including either a shiftable movement or a rotatable movement of an object, or both.

2. Brief Description of the Prior Art

There have been various water activity toys in the prior art and some of which are useful as a so-called "bathtub" toy. One such prior art bathtub activity toy included a housing in which water was poured into the housing to turn a water wheel. The water was introduced into a funnel and the funnel permitted the water to be dropped into cavities in the water wheel to turn the same.

A commercially usable photographic print washing tray had a pair of compartments separated by an upstanding divider. When held under a faucet dispensing water, one compartment of the tray was filled to a certain level, the tray tipped to one side permitting the water to discharge from that compartment. The divider then diverted water flow into the next compartment and when the next compartment filled, the tray would thereupon shift back to its initial position where water was introduced again into the first of the compartments and this cycle would continue.

In the prior art water activity toy and in the photographic tray, a fair amount of water, or at least water under significant pressure, was required in order to create the desired action. Thus, in the case of the water wheel, water had to be introduced at sufficient pressure and in sufficient volume in order to turn the water wheel. This prior art water activity toy was confined for use in a location where there was a readily available source of water, usually under pressure, e.g. a water tap. In the case of the photographic tray, the water had to be introduced in sufficient amount in order to create the tipping action of the tray.

OBJECTS OF THE INVENTION

It is, therefore, the primary object of the present invention to provide a liquid activity toy in which the introduction of a relatively small amount of liquid at ambient pressure into the toy creates at least one or more movements or activities, as for example, a shiftable movement of a toy object out of and into the toy housing, and/or the movement of a toy object in a circular path.

It is also an object of the present invention to provide a liquid activity toy of the type stated in which a separate actuating means is employed to cause each activity and with a single reservoir for all of the actuating means or a separate reservoir for each actuating means and with the reservoir or reservoirs receiving and slowly dispensing the liquid.

It is another object of the present invention to provide a liquid activity toy of the type stated in which the introduction of liquid into the toy permits the rising up of a toy object in response to a relatively small amount of liquid dropped into a container, and the ultimate dropping of the toy object back into the toy housing after the discharge of the liquid therefrom.

It is a further object of the present invention to provide a liquid activity toy of the type stated in which a toy object will rotate in a somewhat arcuate path upon the introduction of a relatively small amount of liquid into the housing, such that the liquid will cause the rotation of a toy object.

It is an additional object of the present invention to provide a liquid activity toy of the type stated which can be floatably supported in a body of liquid, such as water, or used on a solid supporting surface.

It is another salient object of the present invention to provide a liquid activity toy of the type stated which is relatively simple and highly durable in its construction and in which various actions can occur upon the introduction of only a small amount of liquid into the toy.

With the above and other objects in view, our invention resides in the novel features of form, construction, arrangement and combination of parts presently described and pointed out in the claims.

SUMMARY OF THE DISCLOSURE

A liquid activity toy having an outer housing, in the form of a closed container, with one or more liquid inlets and in which the introduction of a liquid, such as water, into the toy housing by a child user actuates means to cause one or more activities or actions to occur. A first of these actions is the rising of a toy object to a position outward of the toy housing and the subsequent dropping of the object back into the housing, and where the object may represent a toy flower and the action represents the growing of a toy flower. A second action which may occur by the introduction of water is the rising up of a second toy object which may represent a toy animal, for example, and which may thereafter subsequently drop back into the housing. A third action which may occur upon introduction of water into the housing is the movement of a third toy object in a circular path. This third object may represent a toy animal or insect, as for example, a flying bee.

Each of the aforementioned actions or activities is created by a separate actuating means or actuating assembly. Each assembly includes a separate reservoir to receive water or other liquid which may be introduced into the reservoir of limited capacity and which is dispensed slowly from a spout having a small diameter or orifice on the underside of the reservoir. The dispensed liquid will then operate a mechanism which causes the activity to occur. In like manner, each assembly may be operated in conjunction with a single reservoir dispensing liquid to the separate mechanisms of the assemblies. The spout in some of the reservoirs extends slightly below the bottom wall of the reservoir to thereby prevent a "sheeting" of the liquid, resulting from liquid surface tension, which would otherwise occur with a small orifice.

In accordance with this construction, it is possible to obtain the desired action with only a small amount of water and, in addition, the activity can continue for a period of time after pouring water into the reservoir. As an added advantage, the liquid activity toy is not confined for use in a location where there is a readily available source of liquid under pressure, such as a conventional house water tap. Thus, the child user may take the toy into an area where water spillage is not damaging as in a yard and where no source of liquid is available other than, for example, a pitcher of water.

As indicated above, it is possible to construct the liquid activity toy with a single reservoir which enables simplicity in construction and reduced construction costs. However, it is also possible to construct the toy with a separate reservoir for each actuating mechanism. The use of the separate reservoir for each actuating mechanism permits the selection of any of the various types of activities and associated actuating mechanisms to be used, or included in any of the embodiments of the liquid activity toy. Moreover, by using a separate reservoir or each actuating mechanism, it is possible to control the liquid discharge rate for each particular actuating mechanism.

The actuating means which creates each of the aforesaid actions is located within and is completely hidden from view in the closed housing. When the water or other liquid is introduced into the housing, it will operate the actuating assembly within the housing and which will cause visual movement outside of the housing. Moreover, the housing is provided with a plurality of drainage apertures so that the water which is introduced into the housing may be readily drained therefrom so that it does not interfere with further operation of the various actuating assemblies.

It can be observed that each of the actions which occur are highly visual and, moreover, may be related in terms of the action or activity being depicted. Thus for example, the introducing of water into an object representative of a flower causes the flower to "grow", that is, rise out of the housing. In addition the rotating object, as for example, the bee, represents the flying movement of a bee in close relation to the growing flower. Finally, the shiftable object, such as the gopher, is designed so that it will continually pop out of and into the housing much in the manner of a gopher successively sticking its head out of and back into a gopher hole in the ground.

As noted above, the activity can occur with a relatively small supply of water. The discharge orifices of the reservoirs are made quite small. For one particular embodiment of the toy, it has been found that the desired action can occur with four ounces of water or less. Thus, for example, in that embodiment the rotating object such as the object representing a bee will rotate for about eight to ten seconds with four ounces of water. When four ounces of water is poured into the object representative of the flower, the flower will rise and slowly drop back into the housing from its fully raised position to its lowermost position in a period slightly in excess of one minute. In addition, when four ounces of water is introduced into the reservoir controlling the object representative of the gopher, this object will pop up and down in successive cycles for a period of fifteen to twenty seconds. Thus, using four ounce reservoirs, the actions will continue for a substantial period of time after the water had been introduced into the reservoirs. However, the reservoirs, of course, may be sized to contain a volume of liquid greater than four liquid ounces.

In the above described embodiment, the housing had an overall diameter of about 7 inches and an overall height of about $3\frac{3}{4}$ inches. The diameter of a tube carrying the object representative of a flower was about $\frac{3}{4}$ inches and the post and flower object raised upwardly from the housing for about two inches. The object representative of the gopher and the post it was mounted on raised about $1\frac{1}{4}$ inches and the post had a diameter of about $\frac{3}{8}$ inches. The object representative of the bee moved in a circular path having a diameter of about $1\frac{1}{4}$ inches.

A first assembly in the housing which causes the first object to shift outwardly of the housing and back into the housing comprises a cylindrically shaped sleeve located within the housing to form a liquid receiving chamber, such as a water receiving chamber or reservoir. In addition, a shiftably located tube is located within the sleeve and has an enlarged end which forms an air entrapment chamber therein. As water is introduced through the center of the tube, it is capable of entrapping air within the enlarged end of the tube and will thereby buoy the tube outwardly with respect to the housing. The tube is provided at its upper end with a funnel-like element designed to introduce the water into the tube, and the funnel-like element is also representative of the first toy object, e.g. a toy flower. A liquid discharge opening is formed within the lower end of the reservoir permitting the discharge of water at a relatively slow rate therefrom. As the water is so discharged, the tube and the first toy object will slowly fall back into the housing.

The second assembly which causes the rising up of the second object out of the housing and the falling back of the object into the housing comprises a second reservoir also formed within the housing and having an inlet means on the housing for introducing water into the second reservoir. A small container is located beneath a discharge spout in the reservoir, and this container is pivotally mounted on one end of a rockable arm. At the other end of the rockable arm is an upstanding post which carries a second object at its upper end. Thus, as the water from the reservoir is introduced into the container in a sufficient amount, the weight of the water will cause the rockable arm to pivot about a central axis, thereby raising the other end of the arm. The raising of the arm will also raise the second object outwardly of the housing. The second object may have the characterization of an animal, e.g. a toy gopher.

When the container is filled or partially filled with water, it will also pivot on the rockable arm to a position where the water contained therein will be discharged from the container. As a result of the discharge of water, the weight of the post and the second object carried thereby and the moment arm forces imposed on the rockable arm will cause the rockable arm to shift back to its initial position, thereby causing the post and the second object to fall back into the housing.

A third assembly which causes the rotatable movement of the third object generally comprises an upstanding shaft rotatably mounted within the housing with the third object mounted on the upper end of the shaft for rotatable movement therewith. The third toy object is designed to rotate about an upstanding dome which is formed on the upper end of the housing, and this third toy object may adopt the characterization of a flying bird or insect e.g. a flying bee. At its lower end, the shaft is provided with a series of propeller or impeller blades. A third reservoir is formed within the housing to receive a liquid, such as water, through an inlet means formed within the housing. A discharge spout is located on the lower end of the reservoir in approximate vertical alignment with the impeller blades mounted on the shaft. Thus, as the water is slowly dispensed through the spout on the reservoir, the force of the water will cause the impeller blades, and hence the shaft, to rotate, thereby causing the third object to rotate on the outside of the housing.

The liquid activity toy of the present invention may include one or more of these assemblies in order to provide the movement of any one or more of the associated three objects. In addition, other assemblies and objects which are movable could also be formed within the housing in accordance with the present invention. Moreover, the movable objects could simulate any human or animal figure or plant object or other form of inanimate object.

The toy apparatus is provided with a flotatable tube which may be removably secured to the lower end of the housing. In this way, the liquid activity toy may be designed to float in or be supported in a body of water, such as in a swimming pool, a bathtub or sink.

BRIEF DESCRIPTION OF THE DRAWINGS

Figure 1:
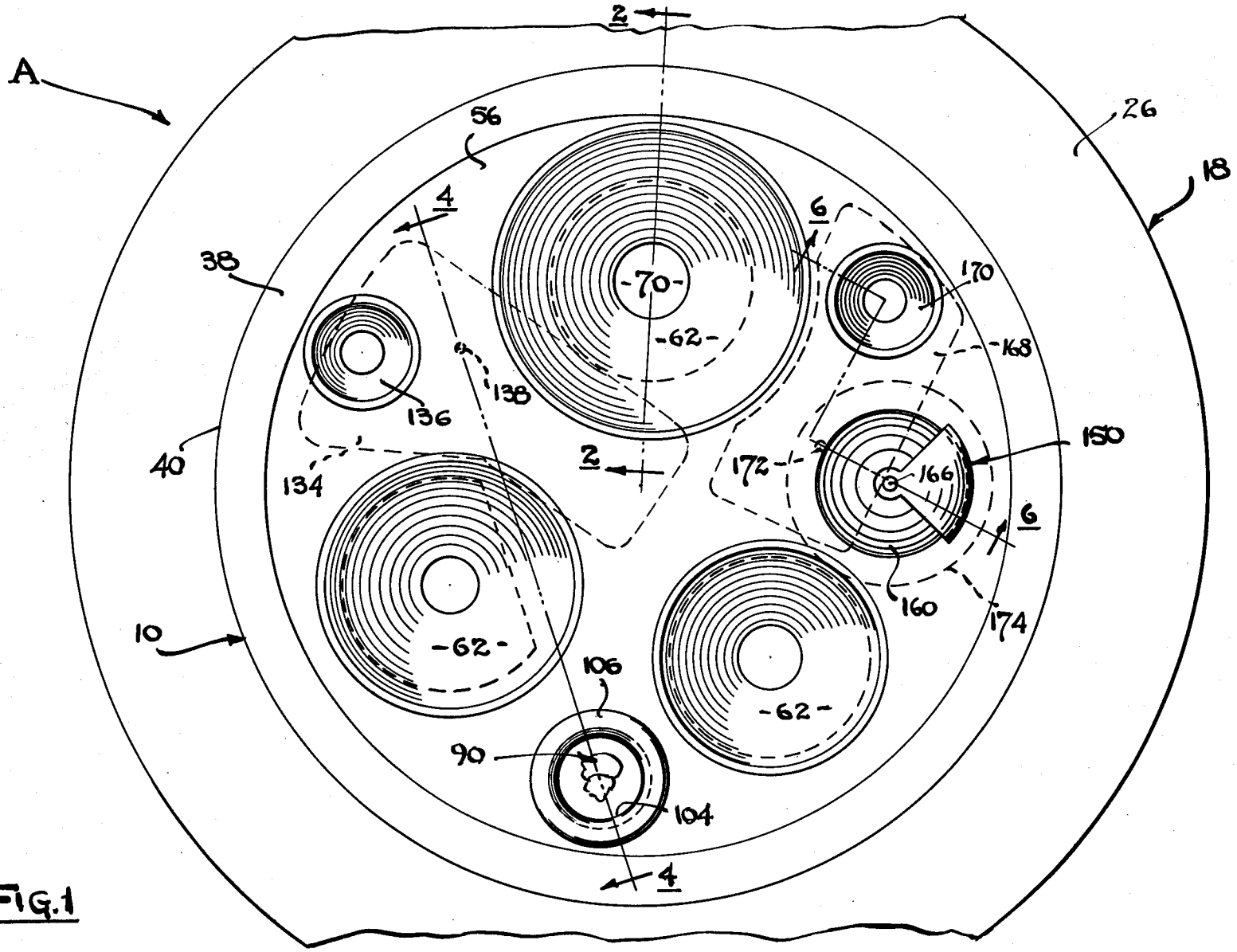
Figures 2, 3:
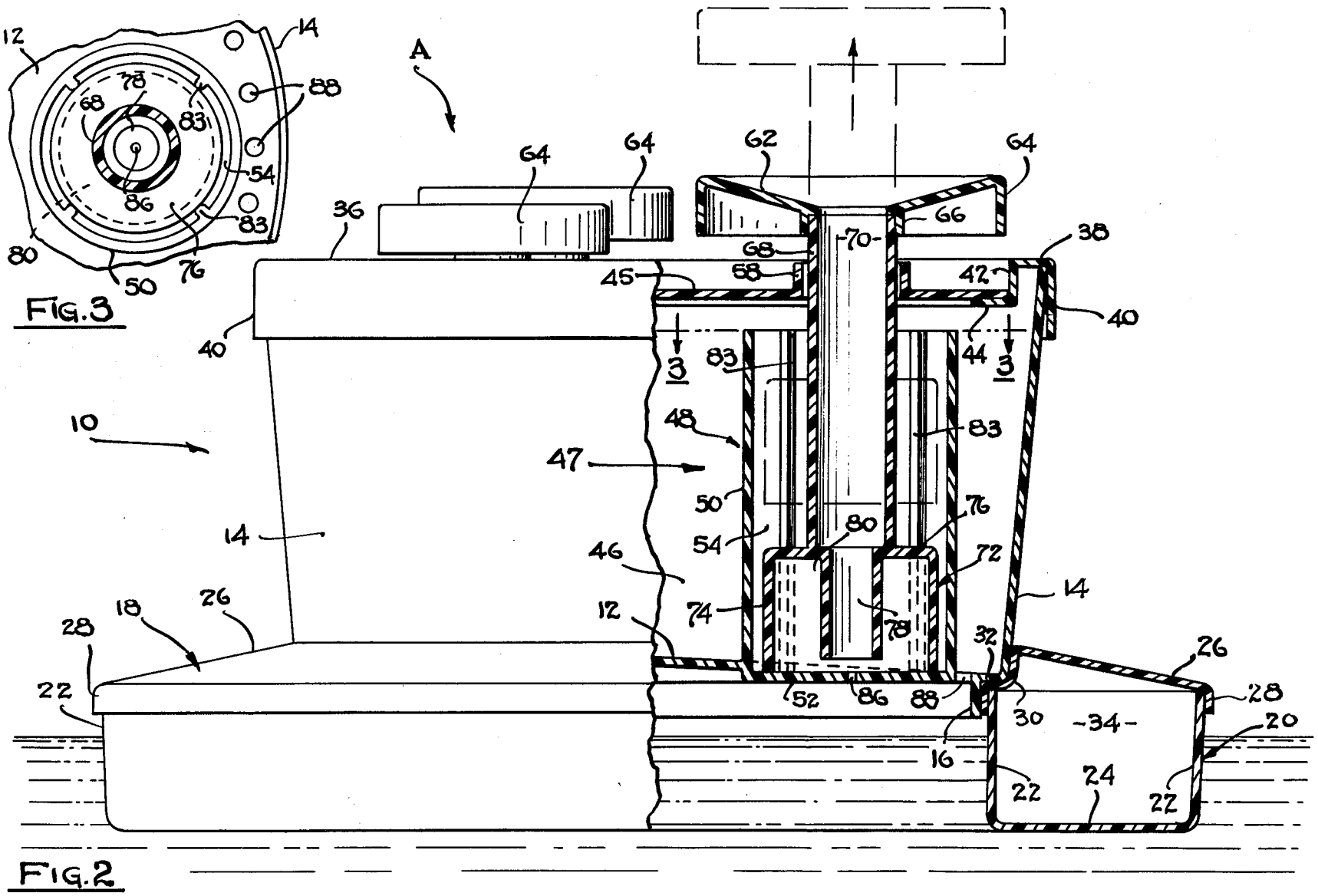
Figure 5:
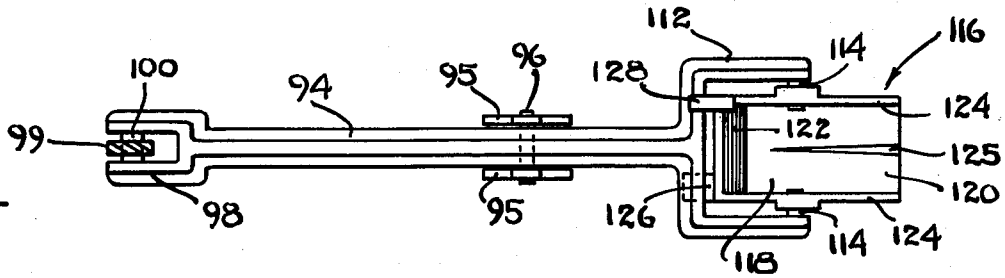
Figure 4:
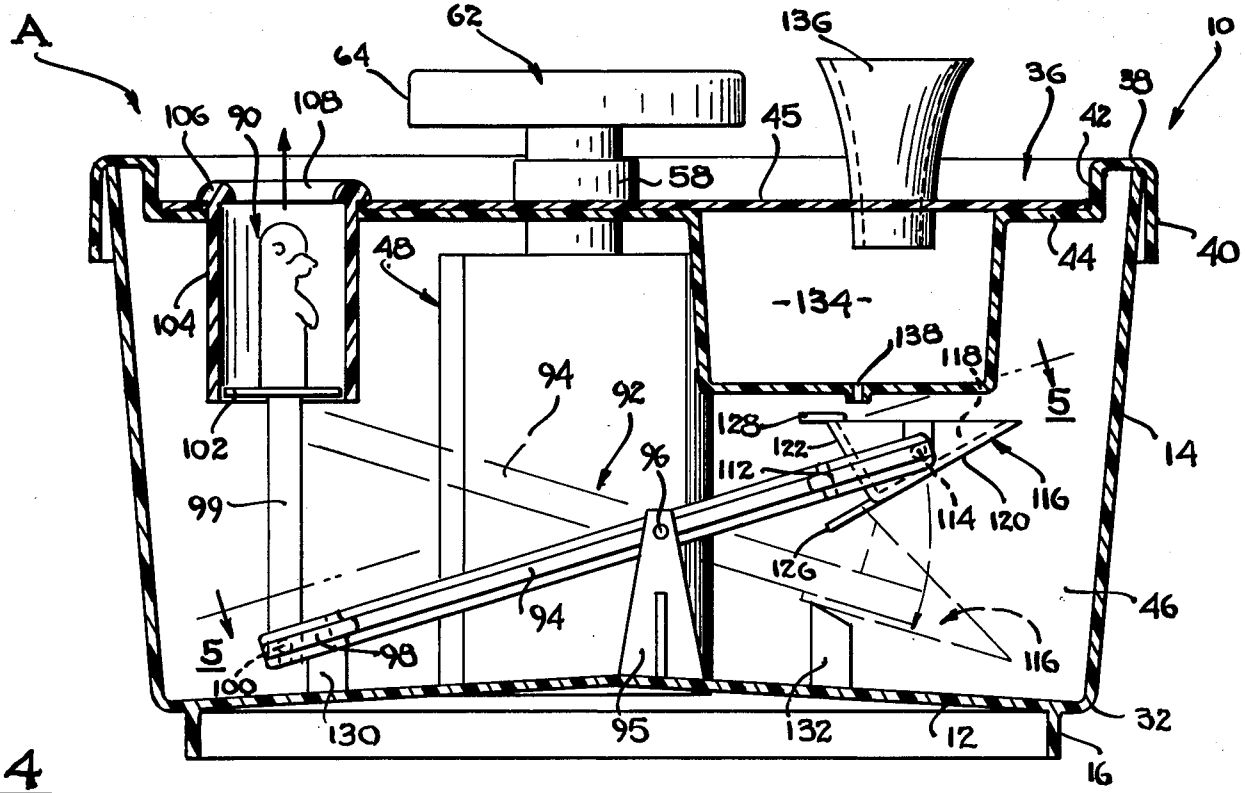
Figure 6:
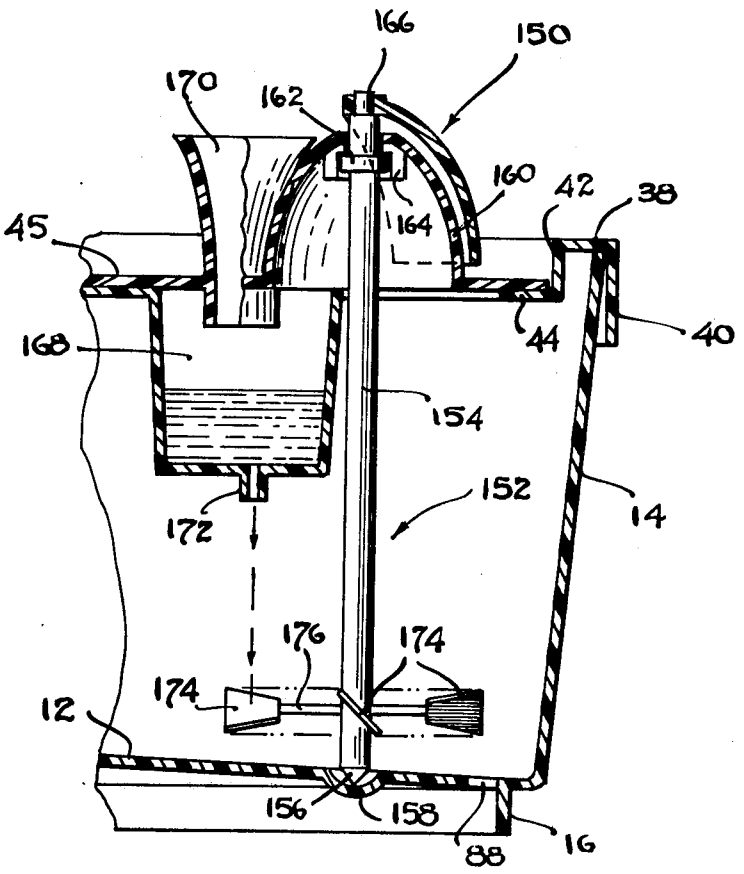

Having thus described the invention in general terms, reference will now be made to the accompanying drawings in which:

FIG. 1 is a top plan view, partially shown in dotted lines, of the liquid activity toy constructed in accordance with and embodying the present invention;

FIG. 2 is a side elevational view, partially broken away and in section and taken along line 2—2 of FIG. 1;

FIG. 3 is a horizontal sectional view taken along line 3—3 of FIG. 2;

FIG. 4 is a vertical sectional view taken along line 4—4 of FIG. 1;

FIG. 5 is a somewhat horizontal sectional view taken along line 5—5 of FIG. 4; and FIG. 6 is a fragmentary vertical sectional view taken along 6—6 of FIG. 1.

DETAILED DESCRIPTION OF A PREFERRED EMBODIMENT

Referring now in more detail and by reference characters to the drawings which illustrate a preferred embodiment of the present invention, A designates a liquid activity toy, generally comprising an outer housing 10 having a base wall 12 and an upstanding cylindrically shaped side wall 14 integrally formed with the base wall 12. Also integrally formed with the base wall 12 is a downwardly struck cylindrically shaped retaining flange 16 which has a diameter, at least somewhat less than that of the side wall 14.

The liquid activity toy of the present invention may be used in a body of liquid, as for example water, in or at a bathtub or a sink or like container of water. In this case, the water activity toy is provided with a flotatable ring 18, which is comprised of a U-shaped body 20 having a continuous side wall 22 and a connected bottom wall 24. Disposed above the side wall 22 is a top wall 26 having a downwardly struck locking flange 28, integrally formed therewith. One portion of the top wall 26 is provided with a shoulder 30 in order to receive an edge portion 32 on the side wall 14 of the housing 10.

The flotatable ring forms a generally sealed air chamber 34 therein, so as to support the liquid activity toy on the body of water, much in the manner as illustrated in FIG. 2 of the drawings. It can also be observed that the retaining flange 16 fits within and engages the inner portion of the locking flange 28, also in the manner as illustrated in FIG. 2 of the drawings. In this way, the flotatable ring 18 can be removably snap-fitted to the lower end of the housing 10.

Disposed upon the upper end of the cylindrically shaped enclosing side wall 14 is a cover member or so-called "cover plate" 36 which includes a cylindricall shaped horizontal rim section 38 which integrally merges into a depending cylindrically shaped and annularly extending side wall flange 40. The flange 40 snugly engages the exterior surface of the cylindrically shaped side wall 14, in the manner as illustrated in FIGS. 2 and 4 of the drawings, so that the cover plate is removably snap-fitted on the upper end of the housing 10.

The horizontal rim section 38 also integrally merges into a depending section 42 which in turn integrally merges into a horizontal retaining wall 44, much in the manner as illustrated in FIGS. 2 and 4 of the drawings. In this way, it can be observed that the bottom wall 12 along with the cylindrically shaped side wall 14 and the cover member 36 provide an interior chamber 46 within the housing 10. A circularly shaped top plate or so-called "close-out plate" 45, also often referred to as a "doubler", is disposed over the horizontal wall 44 for reasons which will presently more fully appear. The top plate 45 is sized to snugly engage the depending section 42 of the cover plate 36.

As indicated previously, the liquid activity toy of the present invention comprises a plurality of individual actions or activities which may be generated by the introduction of a liquid such as water into the toy. As indicated previously, any number of actions or activities, as for example, one or two or more actions may be incorporated into the liquid activity toy of the present invention. However, in the embodiment as illustrated, five such actions or activities are shown. Moreover, in the embodiment of the invention as illustrated and described herein, five assemblies or movement generating mechanisms are provided with each generating one of the different actions or activities. However, three of the actions mentioned are that of representing a growing flower, and three of the actions representing the grown flower are of the same type and substantially identical in structure and operation. Thus, only one such action is shown and described. The other two actions are different in construction and operation and are described more fully in detail hereinafter.

The first of these actions involves the rising up or the "growing" of a first toy object, as for example, a toy flower or similar object. The second of these actions involves the rising up and the dropping of a second toy object, as for example, a representation of an animal figure or human figure, or the like. The third of these activities involves the rotating of a third toy object representing a toy insect or animal, as for example, a bee.

Referring now to FIG. 2, it can be observed that the first of these actions illustrates the rising up of an object representative of a flower and includes a first object movement generating mechanism 47 located within the interior chamber 46. The movement generating mechanism 47 comprises a container 48 connected to the bottom wall 12 and which container 48 includes a cylindrically shaped side wall 50 snap-fitted or otherwise rigidly inserted into the bottom wall 12, much in the manner as illustrated in FIG. 2. The enclosing side wall 50 is further provided with a base close-out wall 52, thereby forming an interior chamber 54. By further reference to FIG. 2 of the drawings, it can be observed that the cylindrically shaped enclosing side wall 50 extends upwardly toward the cover member 36.

The top plate 45, or so-called "doubler", is provided with an integrally formed cylindrically shaped upstanding guide flange 58. Shiftably disposed within the guide flange 58 is an elongate cylindrically shaped tube which integrally merges into a frustro-conical funnel 62 at its upper end and having a depending annularly extending side wall flange 64. The frustro-conical funnel 62 and the flange 64 represent a toy object in accordance with the present invention, and this object may adopt any form of representation, as for example, the toy flower. For this purpose, a representation of a toy flower may be painted or otherwise imprinted on the upper surface of the funnel 62.

The funnel 62 is integrally formed with an interior depending tubular mounting flange 66, which is rigidly secured to a vertically disposed tube 68 having an interior bore 70 defining a liquid duct. At its lower end, the tube 68 is integrally formed with or otherwise provided with an end section such as an enlarged base 72 having a skirt section 74 and a top wall 76 which is integrally connected to the lower end of the tube 68. In addition, the skirt section 74 engages the bottom wall 52 of the container 48, much in the manner as illustrated in FIG. 2 of the drawings.

The top wall 76 of the base section 72 integrally merges into a depending water inlet tube 78 which is spaced slightly above the base wall 52. The water tube 78 is somewhat diametrally smaller than the tube 68 in the manner as illustrated in FIG. 2. In this way, when water is introduced into the frustro-conical funnel 62, the water will pass through the central bore 70 of the tube 68 into the tube 78 and into a chamber or reservoir 80 which is formed by the cylindrically shaped side wall 74 of the base section 72, the top wall 76, and the base wall 52 of the container 48. As water is introduced therein, the entrained air in the chamber 80 is forced to the top of the chamber 80 inasmuch as it cannot escape beyond the chamber 80. When the total weight of the assembly is exceeded by the displacement volume the air in the chamber 80 will be compressed to a sufficient extent so that the tube 68, including the base section 72, will rise with respect to the container 48. In this way, the frustro-conical funnel, which is representative of a toy object, will tend to rise to the position as shown in the phantom lines of FIG. 2 of the drawings.

The side wall 50 is provided with a plurality of vertically extending radially inwardly struck splines or guide fingers 83 (four as shown in FIGS. 2 and 3) which slidably engage the side wall 74. The fingers 84 serve to guide the tube 68 in its vertically shiftable movement, that is, from a lower position as illustrated in the solid lines of FIG. 2 to the upper position as illustrated in the phantom lines of FIG. 2. In addition, a discharge opening in the form of a drainage aperture 86 is formed in the base wall 52 in the container 48. Generally the drainage aperture 86 should be sufficiently small so that the water may drain at a relatively slow rate. In this way, when water is introduced into the chamber 80, the compressed entrained air will cause the tube 68 and the funnel 62 to rise, as aforesaid. Nevertheless, water will be retained in the container 48 and this water will be slowly discharged through the discharge aperture 86. As the water is discharged, through the aperture 86 into the sink or bathtub or other area, the air which had been entrained and compressed will become decompressed. Hence, the tube 68 and the funnel 62 will fall to their lowermost position, as illustrated in the solid lines of FIG. 2 of the drawings. In some cases, it may be desirable to replace the drainage aperture 86 with a drainage spout which extends downwardly from the reservoir 80 in order to avoid water sheeting effects.

In accordance with the above construction, it can be observed that by the introduction of a relatively small amount of water into the chamber 80, the tube 68, and hence the funnel 62, will rise, representing the rising of an object such as the growing of a flower. As the water is discharged therefrom, the object 62 will thereafter drop to its lowermost position. In this respect, further introduction of water will again compress air in the chamber 80 and cause the tube 68, and hence the funnel 62, representative of a toy object, to rise.

The bottom wall 12 of the housing 10 is provided with a plurality of drainage apertures 88 which are more fully illustrated in FIGS. 2 and 3 of the drawings. Generally, the drainage apertures are located around the periphery of the housing 10 in close proximity to the side wall 14. For this purpose, the bottom wall 12 may be slightly concave so that any water which enters the housing 10 can run to the periphery thereof and will be drained through the apertures 88. This feature permits any water which enters the chamber 46 to be drained therefrom. Moreover, it can be observed that even when the liquid activity toy A is used in a body of water, the bottom wall 12 is still spaced upwardly above the surface of the body of water so that drainage of any water which enters into the chamber 46 will not be impeded.

The liquid activity toy of the present invention also provides a second action or activity which includes an object 90 capable of rising up and shifting downwardly into the housing 10. In this case, the second object 90 is a representation of an animal or bird and which is operated by a second movement generating mechanism 92, more fully illustrated in FIGS. 4 and 5 of the drawings.

The second movement generating mechanism 92 comprises a rockable arm 94 which is rockably mounted on an upstanding bracket 95 located on the bottom wall 12. The arm 94 is rockably mounted by means of a pivot pin 96 extending through the bracket 95 so that the arm can shift from a first position, as illustrated in the solid lines of FIG. 4, to a second position, as illustrated in the phantom lines of FIG. 4. At the left-hand end, the rockable arm 94 is provided with a bifurcated end 98 for pivotably mounting to a vertically shiftable post 99 through a pivot pin 100.

The object 90, which in this case is representative of a gopher, is provided with an integrally formed retaining plate 102 which is, in turn, secured to the post 99, in the manner as illustrated in FIG. 4 of the drawings. Thus, when the rockable arm 94 is shifted to its second position, that is, the position as illustrated in the phantom lines of FIG. 4, the toy object 90 will be shifted outwardly of the housing. In like manner, when the rockable arm 94 is shifted back to its initial or first position, then the toy object 90 will be dropped back into the housing.

Mounted on the top wall or doubler 45 and extending into the chamber 46 is a cylindrically shaped sleeve 104 serving as an object retaining housing. The sleeve 104 is integrally provided with an enlarged annularly extending bead 106 which engages or is secured to the top wall 45 and retains the sleeve 104 within chamber 46. Moreover, the sleeve 104 is provided with an open upper end 108 in order to permit the object 90 to shift outwardly of and back into the housing 10. Inasmuch as the retaining plate is integral with or otherwise rigidly secured to the object 90, a child user cannot grasp the object 90 and attempt to pull the same from the housing since the retaining plate 102 will engage the bead 106.

At its other end, the rockable arm 94 is also provided with an enlarged bifurcated end section 112 and pivotally mounted on the bifurcated end section 112, by means of pivot pins 114, is a somewhat triangularly shaped water receiving cup or similar container 116, having a water receiving chamber 118. The cup 116 is provided with a bottom wall 120 connected by a back wall 122 and a pair of side walls which are tapered downwardly from the back wall 122 and terminate at the right-hand end of the bottom wall 120. The bottom wall 120 is provided with an elongate groove 125 in the center portion thereof in order to provide a bleed channel and provide for easy drainage from the cup 116. In place of the groove 125, the bottom wall could be U-shaped. This construction is desirable in that the small amount of water in the cup would not easily otherwise drain due to surface tension effects. In addition, the bottom wall 120 is provided with a lower rearwardly struck limit tab 126 and the back wall 122 is similarly provided with an upper rearwardly struck limit tab 128. The operation of the cup 116 is more fully described in detail hereinafter.

The bottom wall 52 is also provided with a pair of upstanding posts 130 and 132 which are more fully illustrated in FIG. 4 of the drawings. The post 130 is located toward the left-hand end of the housing and serves as a limit stop for the rockable arm 94 when in its first position. The post 132 serves to trip cup 116 thru engagement with the tab 126 when the rockable arm 94 is shifted to its second position. It can be observed that each of the posts 130 and 132 have bevelled upper surfaces in order to receive the rockable arm 94.

The horizontal wall 44 is integrally provided with a downwardly located liquid reservoir 134 and which receives a liquid, such as wter, through a funnel 136 mounted on the top plate 45 and extends above the housing 14, in the manner as illustrated in FIG. 4 of the drawings. The reservoir 134 is also provided with a discharge opening in the form of a spout 138 in the lower portion thereof and which is in approximate alignment with the chamber 118 of the cup 116. The discharge spout 138 has a relatively small diameter orifice in order to permit water to drain at a relatively slow rate. Again, the discharge spout 138 could extend slightly downwardly from the reservoir 134 to obviate the problem of water sheeting due to surface tension.

Water can be introduced through the funnel 136 and into the reservoir 134 and which will slowly discharge into the cup 116. As this occurs, and when the cup 116 is filled or partially filled, the rockable arm 94 and the cup 116 carried thereby will pivot in the clockwise direction to its second position so that the limit post 132 engages the tab 126. Water must be introduced into the cup 116 in an amount to provide a sufficient weight to create a vertical vector greater than that provided by the weight of the object 90 and the post 98. As this condition arises, the rockable arm 94 will shift to its second position, as illustrated in the phantom lines of FIG. 4. Moreover, the object 90 will then shift outwardly of the housing in the manner as previously described.

When the rockable arm 94 is shifted to the second position, the limit tab 126 will engage the post 132 causing the cup 116 to rotate in a clockwise direction, reference being made to FIG. 4. In this latter position, the water will then drain from or pour out of the cup 116 and will also drain from the housing 10 through the drainage apertures 88. As the water has been discharged from the cup 116, the weight of the object 90 and the post 99 will thereupon force the rockable arm 94 to shift to its initial or first position, as illustrated in the solid lines of FIG. 4.

It can also be observed by reference to FIG. 4 of the drawings that as the rockable arm 94 and the cup 116 shift to the second position, as illustrated in the phantom lines, the cup 116 will be shifted out of alignment with the drain spout 138. Thus, any water passing through the spout 138 will pass to the left of the cup 116. This action will permit the cup 116 to drain without further introduction of water therein until it fully drains and shifts back to its initial position.

As indicated previously, when constructing the apparatus, the weight of the cup 116 on one end of the arm 94, when filled or partially filled with water, must present a greater vertical vector in the downward direction than that created by the object 90 and the post 99. Conversely, when the cup 116 is empty, the vertical downward vector created by the weight of the object 90 and the post 99 must be greater than that created by the cup 116. In this regard, the respective sizes of the moment arms extending from the pivot pin 98 to the pivot pin 122 for the cup 116 and the pivot pin 100 for the post 99 must be taken into consideration as well.

It can be observed that the chamber 118 of the cup 116 is considerably smaller than the reservoir 134. Thus, when the rockable arm 94 is shifted to the second position and the cup 116 discharges the water therefrom, the rockable arm 94 will thereupon again shift back to its first position. As this occurs, the extra amount of water in the reservoir 134 will again discharge into the cup 116, thereby causing the same action to occur. Thus, the child user only has to pour a sufficient amount of water into the reservoir 134 in order to cause the object 90 to pop up and down on several successive occasions. Moreover, this action may occur simultaneously with any of the other actions generated by the liquid activity top of the present invention.

A third action or activity which may occur in the liquid activity toy of the present invention involves the rotating of a toy object which may represent a toy insect, as for example, a bee. In this case, the liquid activity toy of the present invention comprises a third object 150 and a motion generating mechanism 152 for causing rotation of the object 150 and which are more fully illustrated in FIG. 6 of the drawings.

The motion generating mechanism 152 generally comprises a vertically disposed shaft 154 which is provided with a somewhat pointed lower end 156 and which is journalled in and retained by a dimple 158 formed within the bottom wall 12. The upper end of the shaft 154 extends through an upstanding dome 160 which is secured to, or otherwise integrally formed with, the top plate 45. Moreover, the upper end of the shaft 154 is provided with a retaining disc 162 which fits within a recess 164 formed within the dome 160. In this way, axial movement of the shaft 154 is restrained, although the shaft 154 is rotatable. The object 150 is mounted on the outer end of the shaft 154 and is located slightly above the dome 160 and is also rotatable therearound. The object 150 is retained on the upper end of the shaft 154 by means of a pin 166. It can be observed that the dome is somewhat conical in shape and the object 150 is somewhat arcuate in shape and essentially represents a portion of a conic shape. Nevertheless, the object 150 may be provided on its exterior surface with the representation of a bee or other representation which the object is to characterize.

The horizontal wall 44 is also integrally formed with another downwardly located liquid reservoir 168 and which is disposed within the central chamber 46 of the housing 10. Moreover, a liquid, such as water, may be introduced into the reservoir 168 through a funnel 170 which is mounted on and extends through the top wall 45, with the lower end of the funnel 170 extending into the reservoir 168.

The reservoir 168 is also provided with a liquid discharge spout 172 having a discharge opening, which permits water or other liquid to drip from the reservoir 168 at a relatively slow rate and onto a plurality of impeller blades 174 mounted on the shaft 154 through mounting rods 176. As this occurs, the water which is dropped onto the impeller blades 174 will cause rotation of the shaft 154 and hence rotation of the object 150. Moreover, the object 150 will continue to rotate until all of the water in the reservoir 168 has been discharged therefrom. In addition, it can be observed that the water which impinges upon the impeller blades 174 will also pass through the drainage apertures 88 and out of the housing 10.

Only four such impeller blades 174 have been illustrated in FIG. 6 of the drawings. However, any number of impeller blades could be provided, depending upon the desired rate of rotation of the object 150. Moreover, the number of impeller blades is also dependent upon the size thereof and the rate at which the liquid is discharged through the discharge opening 172.

The various components forming part of the liquid activity toy of the present invention can be formed of a number of known plastic materials, as for example, polyethylene, polystyrene, polybutadiene, various vinylidene copolymers and the like, and which may be formed in a number of known plastic molding operations, as for example, blow-molding, thermo-forming, injection molding or the like. In addition, for purposes of increased strength and durability, many of the components could be formed of reinforced plastic materials including, for example Fiberglas, boron, carbon and other fibers and grown crystal whiskers incorporated in a suitable matrix, such as an epoxy resin or other thermoplastic or thermosetting resin. Notwithstanding, many of the components of the toy could be formed of other known structural materials, such as metals, etc.

Thus, there has been illustrated and described a unique and novel liquid activity toy which permits one or more actions to occur by the introduction of liquid, e.g. water, into the toy, and which therefore fulfills all of the objects and advantages sought therefor. It should be understood that many changes, modifications, variations and other uses and applications of the toy will become apparent to those skilled in the art after considering this specification and the accompanying drawings. Therefore, any and all such changes, modifications, variations and other uses and applications which do not depart from the nature and spirit of the invention are deemed to be covered by the invention which is limited only by the following claims.

Having thus described our invention, what we desire to claim and secure by Letters Patent is:

1. A liquid activity toy comprising:

(a) a housing, (b) a first mechanism associated with said housing for causing a first object to shift upwardly and outwardly with respect to said housing and retractable back with respect to said housing, said first mechanism comprising:

(1) a first reservoir on said housing for receiving a liquid, (2) a first discharge opening on said first reservoir permitting the liquid therein to discharge therefrom at a relatively slow rate, (3) an arm shiftably mounted within said housing and capable of being shifted from a first position to a second position, (4) pivot means in said housing supporting said arm and permitting said arm to shift between said first and second positions, (5) a container pivotally mounted on one end of said arm in generally vertical alignment with the discharge of said reservoir to receive the liquid therefrom, said arm being located in a first position where the container is located in an upwardly disposed position and said container causes said arm to shift to a second position when the container is disposed in a downwardly disposed position when a certain weight of the liquid has been introduced into said container, (6) an opening in an upper portion of said housing spaced apart from the first reservoir for permitting a first object to pass therethrough and thereby permit shifting from a position inwardly of said housing to a position outwardly of said housing, (7) a generally vertically disposed post operatively connected to said arm and being located on the opposite side of said pivot means with respect to said container and being located in vertical alignment with said opening, and (8) a said first object carried by said post at the upper end thereof and capable of being shifted from a position inwardly of said housing to a position outwardly of said housing when said arm has been shifted to the second position, said container having a shape such that it will pivot when said arm has been shifted to the second position thereby causing the liquid to discharge from the container and thereby permitting the arm to shift back to the first position by the weight of the post and the first object;

(c) a second mechanism for causing a second object to shift outwardly with respect to said housing and rectractable back with respect to said housing, said second mechanism comprising:

(1) a second liquid reservoir located with respect to said second object, (2) a vertically shiftable member located with said housing and having a first end section communicating with said second liquid reservoir, (3) a second object mounted on the upper end of said vertically shiftable member and capable of being moved from a lower position with respect to said housing to a position upwardly and beyond said housing, (4) means defining a liquid duct in said shiftable member, (5) an end section on said shiftable member located within said second reservoir, (6) a liquid introduction means on an end section of said shiftable member in common-section with said duct for introducing a liquid into said second liquid reservoir in amounts to entrap air with respect to said first end section and thereby buoy said shiftable member and said second object with respect to said housing, and (7) a second discharge opening located on said second reservoir and permitting the liquid to discharge therefrom at a relatively slow rate to permit discharge of liquid from said second reservoir to permit the resultant shifting of said shiftable member and second object back from its outwardly shifted position for a period of time after introduction of liquid into said second reservoir, said shiftable member starting its shiftable movement back toward said housing almost simultaneously with the cessation of introducing liquid into the second reservoir, and thereafter the shiftable member is permitted to stop movement when the liquid is substantially drained from said second reservoir;

(d) a third mechanism associated with said housing for causing a third object to rotate with respect to said housing, said third mechanism comprising:

(1) a third reservoir on said housing for receiving a liquid, (2) a third discharge opening on said third reservoir permitting the liquid therein to discharge therefrom at a relatively slow rate, (3) a rotatable shaft in said housing spaced apart from said third reservoir, (4) a third object located outwardly of said housing on the upper end of said rotatable shaft and being rotatable therewith, and (5) a plurality of blades on said rotatable shaft located to be contacted by the liquid discharged from the third liquid discharge opening on said third reservoir, the number of blades and the positions thereof being sufficient to cause said rotatable shaft, and said third object to rotate rapidly when the liquid impings upon the blades, said third discharge opening permitting the liquid to discharge therefrom for a period of time after introduction of liquid into said third reservoir.

2. The liquid activity toy of claim 1 further characterized in that a funnel means on an upper portion of said housing permits introduction of a liquid into said reservoir at a greater rate than said discharge opening permits discharge of a liquid therethrough.

3. The liquid activity toy of claim 1 further characterized in that said housing is removably retained by a liquid flotable member so that said liquid toy can be floated on a body of liquid.

4. The liquid activity toy of claim 1 further characterized in that said housing is provided with a plurality of liquid drainage apertures.

5. The liquid activity toy of claim 1 further characterized in that said first discharge opening comprises a discharge spout on each of said reservoir with a diameter sufficiently small to cause a relatively slow discharge rate of the liquid in the reservoir.

6. The liquid activity toy of claim 1 further characterized in that said first object is located within a receptacle having an upper rim surrounding said opening, said post also having a plate thereon to limit upper movement of said post and said first object and to prevent said first object from being pulled out of said receptacle.

7. The liquid activity toy of claim 1 further characterized in that a dome is located on said housing and said third object rotates about said dome.

8. The liquid activity toy of claim 1 further characterized in that funnel means is located on said housing and permits introduction of a liquid into said third receptacle.

9. The liquid activity toy of claim 1 further characterized in that a guide sleeve is located within said housing and surrounds said shiftable member and guides the shiftable movement thereof.

* * * * *